US005304749A

United States Patent [19]

Crandell

[11] Patent Number: 5,304,749

[45] Date of Patent: Apr. 19, 1994

[54] MUFFLER FOR INTERNAL COMBUSTION ENGINE

[76] Inventor: Rodney Crandell, 4567 New River Stage 2, Phoenix, Ariz. 85027

[21] Appl. No.: 47,707

[22] Filed: Apr. 14, 1993

Related U.S. Application Data

[63] Continuation of Ser. No. 760,568, Sep. 16, 1991, abandoned.

[51] Int. Cl.[5] ..... F01N 1/08

[52] U.S. Cl. ..... 181/264; 181/268; 181/269; 181/282

[58] Field of Search ..... 181/251, 257, 264, 265, 181/268, 269, 270, 272, 275, 281, 282

[56] References Cited

U.S. PATENT DOCUMENTS 4,574,914 3/1986 Flugger ..... 181/268

5,123,502 6/1992 Flugger ..... 181/264

*Primary Examiner*—Russell E. Adams

*Assistant Examiner*—Khanh Dang

*Attorney, Agent, or Firm*—LaValle D. Ptak

[57] ABSTRACT

A compact muffler for an internal combustion engine provides significant sound attenuation and back pressure reduction. The muffler is fabricated in the form of an elongated rectangular box with the exhaust pipe connected to an inlet in the center of one end, and the tail pipe of the vehicle connected to an outlet through the opposite end. Several wedge-shaped or V-shaped exhaust pulse splitting plates are located within the casing to split and recombine the stream of exhaust pulses passing through the casing. The splitting devices are located in the casing in positions which cause the different split streams of the exhaust pulses to be intercepted at different distances to cause the pulses passing through different parts of the casing to be out of phase with one another. The out-of-phase streams of the split exhaust pulses are recombined to flow out of the outlet.

17 Claims, 2 Drawing Sheets

MUFFLER FOR INTERNAL COMBUSTION ENGINE

This is a continuation of application Ser. No. 07/760,568, filed Sep. 16, 1991, now abandoned.

BACKGROUND

Many different types of muffler structures have been proposed, and are in use, for reducing the sound of the exhaust gases flowing from internal combustion engines into the atmosphere. Most of such mufflers attempt to provide such sound reduction with a minimum or back pressure to the engine. In actual practice, however, the most widely used mufflers, and even some highly specialized mufflers, tend to create a substantial amount of back pressure on the engine.

Back pressure causes significant reduction in the useful horsepower of an engine. Back pressure is created, typically, when the exhaust pulse from the engine encounters too much resistance (or not enough acceptance) when it is supplied to the muffler. As a consequence, the exhaust pulse tends to bounce or reflect at least a portion of the pulse back to the engine. Since this occurs with every outgoing pulse, reflected waves or standing waves are produced in the muffler. Since standing waves cause higher pressures on the exhaust system, the ability of the engine to exhaust gases completely from the combustion chamber is reduced. This results in reduced horsepower.

Reflected waves, sometimes known as reversion, cause significant horsepower reduction, or detrimental effects on the engine performance, particularly during the overlap period of the valve openings. Higher horsepower engines have a greater amount of valve or cam overlap, and attempts to significantly attenuate the noise from such engines results in large horsepower reduction (from 20% to 40%) directly caused by the back pressure created in the muffler. This horsepower reduction results from reflected pulses traveling back up the exhaust system to force spent gases back into the combustion chamber. When the pulses are strong enough, they can revert back into the intake manifold during the time when both intake and exhaust valves are open (the cam overlap period). When this occurs, the air-fuel mixture supplied through the intake valve is not only the desired new air and fuel, but also includes an unpredictable amount of spent gases. Primarily because of the unpredictable amounts of spent gases which are recirculated back into the intake manifold, proper ignition is difficult, particularly if large concentrations of spent gases surround the sparkplug at the time it is fired.

Also, if an exhaust system is subjected to relatively high back pressures from the muffler system, the combustion chamber cannot be emptied to a pressure less than the back pressure to which it is subjected. This is the reason an engine exhibits a significant loss of efficiency, since the new gases and fuel vapor are drawn into the cylinder on the basis of a vacuum, which starts with the exhaust pressure. The higher this pressure is, the lower the amount of air and fuel mixture which can be drawn into the cylinder for the next firing cycle.

From the above, it is apparent that any muffler attached to an engine to suppress its sound, which also causes the development of back pressure to the engine, is not satisfactory. Baffle-type mufflers have been developed for providing the desired sound attenuation. To minimize the back pressure created by baffle-type mufflers, such mufflers should be made as large as possible, either in length or diameter. This creates another problem, however inasmuch as the bulk and weight of such mufflers is unacceptable in most applications.

Two mufflers, which have been designed in effort to overcome the problems mentioned above by employing concentric cone-like baffles, are disclosed in the patents to McCurdy U.S. Pat. No. 2,214,770 and Burstein U.S. Pat. No. 4,685,534. The sound attenuator devices of both of these patents are of a generally cylindrical shape. In the devices of both patents, cone-line baffles are employed, and are concentrically arranged with the apex of one cone extending at least partially into the flared opening of the next preceding one in the series. In the devices of both patents, the exhaust gases are directed toward the apices of the cones, and then are spaced uniformly around the outer edges. In the device of the McCurdy patent, the gases are exhausted at different stages, or at different intervals along the length of the device. Consequently, this device would not be acceptable for most automotive applications.

In the device shown in the Burstein patent, the baffles are arranged for the purpose of providing or forming three concentric streams of flowing gases moving at different velocities. The problem with this patent, however, is that gases from the main, nearly straight-through path in the device, are tapped off and added to the surrounding concentric streams in a constricted region; so that back pressure relief is not provided. An examination of the structure of McCurdy also reveals constricted areas which are impacted by the exhaust gases, and which inherently produce back pressure.

Three patents to Egan U.S. Pat. No. 1,170,807; Wood U.S. Pat. No. 2,330,534; and Flugger U.S. Pat. No. 4,809,812 are directed to mufflers which split the flow of gases passing through them by means of conically shaped baffles. The purpose is to reduce back pressure from the exhaust pipe, and to provide for splitting and recombination of the gases passing through the devices to produce the desired sound reduction. Although there is a splitting and reconverging of exhaust gases passing through the devices of all three of these patents, the baffles are all symmetrical; so that all of the splitting and recombining of the pulses of exhaust gases passing through the devices is in phase as the gases pass through the baffle arrangement of the mufflers. In addition, the structures of all of these mufflers include various internal traps or back pressure producing discontinuities.

A muffler of the type known as a resonator-type muffler is disclosed in the patent to Moller U.S. Pat. No. 4,424,882. Considerable back pressure is introduced by a muffler of this type, as is readily apparent from an examination of the internal structure employed.

A different approach to an internal baffle configuration is disclosed in the patent to Malmsten U.S. Pat. No. 4,286,689. The muffler of this patent employs a series of generally conical insert baffles located throughout its length. The baffles, however, are oriented with the wide ends of the cones facing in the inlet side of the muffler. The exhaust gases then are restricted to exit through the smaller openings at the apices of each of the cones or near the apices of the cones. Consequently, the potential for the production of considerable back pressure is present in the muffler disclosed in this patent, even though it may be capable of providing sound attenuation.

It is desirable to provide a muffler for internal combustion engines and the like, which is capable of being fabricated in a relatively small size, and which produces improved sound attenuation with minimal back pressure.

SUMMARY OF THE INVENTION

It is an object of this invention to provide an improved sound attenuating muffler.

It is another object of this invention to provide an improved high efficiency sound attenuating muffler.

It is an additional object of this invention to provide an improved sound attenuating muffler which minimizes the production of back pressure, and which employs devices for splitting the exhaust stream and recombining the split portions of the exhaust stream in an out-of-phase relationship.

It is a further object of this invention to provide an improved sound attenuating muffler which employs a sequence of wedge-shaped baffles located within the muffler body for splitting and recombining the exhaust stream in an out-of-phase relationship without forming back pressure creating traps as the exhaust stream flows through the muffler.

In accordance with a preferred embodiment of this invention, a muffler is constructed in the form of a rectangular box-like casing. The casing has an inlet opening at one end, and outlet opening in the other end. A first exhaust pulse splitting member is located in the housing near the inlet opening to split the exhaust flowing into the casing from the opening into first and second parallel flowing exhaust streams. Additional exhaust pulse splitting members are located to intercept the first and second exhaust streams at different distances from the first exhaust pulse splitting member. After the exhaust has been further split by the additional pulse splitting members, the exhaust streams are recombined and supplied to the outlet opening in the muffler.

DETAILED DESCRIPTION

Reference now should be made to the drawings, in which the same reference numbers are used throughout the different figures to designate the same or similar components.

Figure 1:
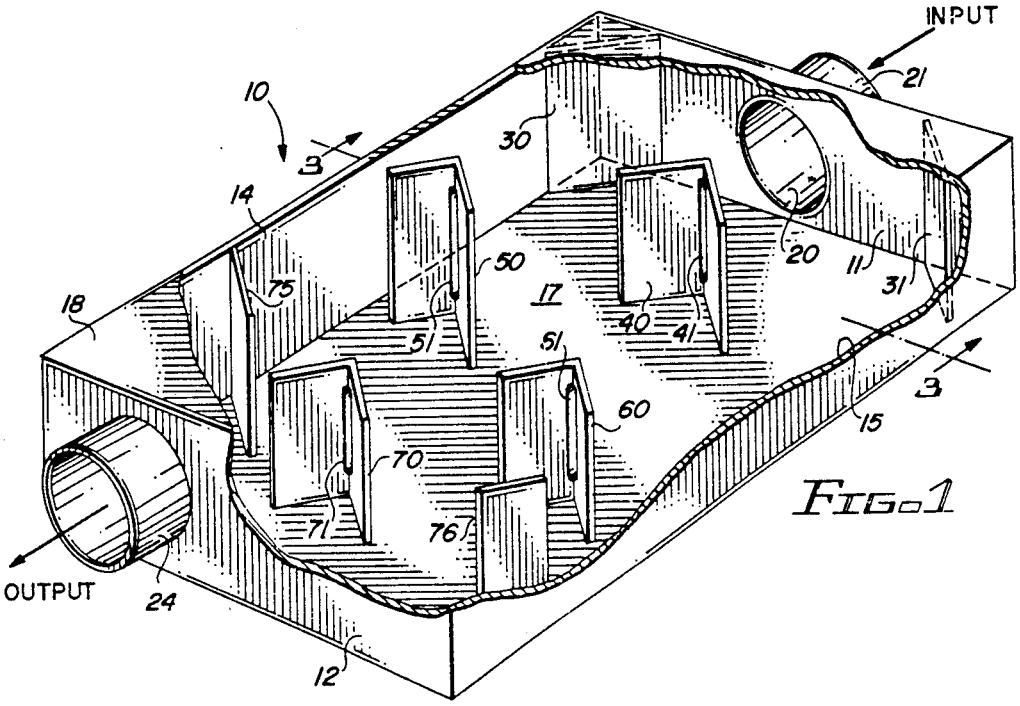
FIG. 1 is a partially cut away top perspective view of a preferred embodiment of the invention.
Figure 7:
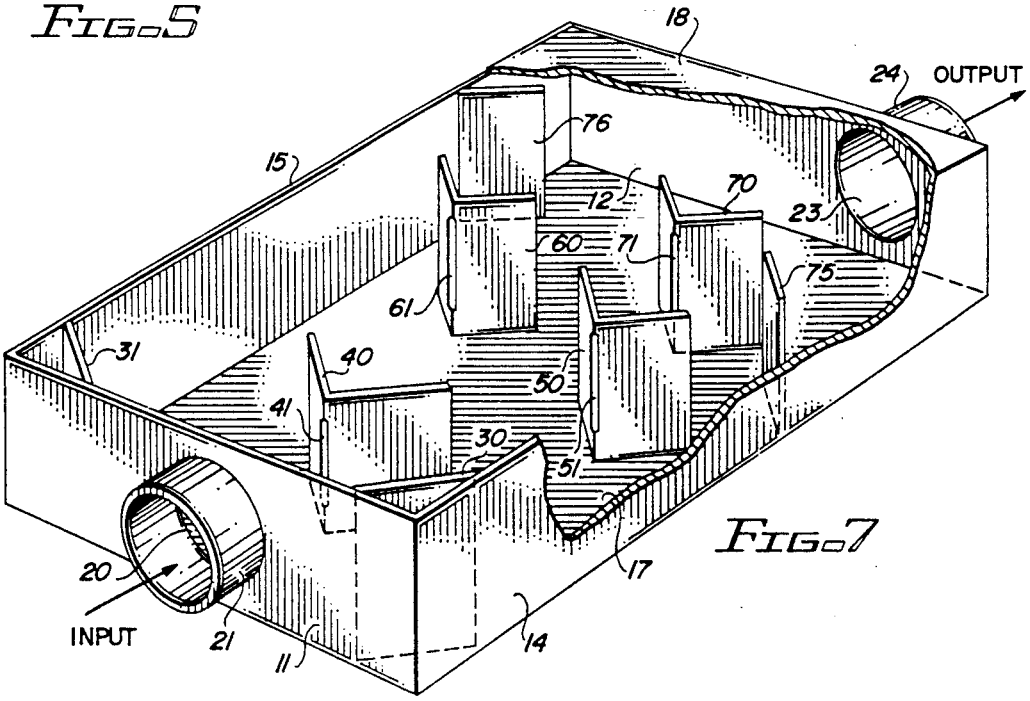
FIG. 7 is a top perspective view of the embodiment of FIG. 1 from the opposite end shown in FIG. 1.

FIGS. 1 and 7 are top cut-away perspective views taken from opposite ends of a muffler 10 constructed in accordance with a preferred embodiment of the invention.

The embodiment shown in FIGS. 1 through 7 is described in accordance with the specific materials and dimensions of a muffler constructed for a typical "small block" V-8 gasoline engine of the type commonly used in pickup trucks and the like. The materials described, and the dimensions given, however, can be modified to accommodate different engines and physical requirements of other types of vehicles with which the muffler of this invention may be used. In addition, various materials may be used, or the use of rust or corrosion resistant coatings or special alloys may be employed in constructing the muffler.

Figure 2:
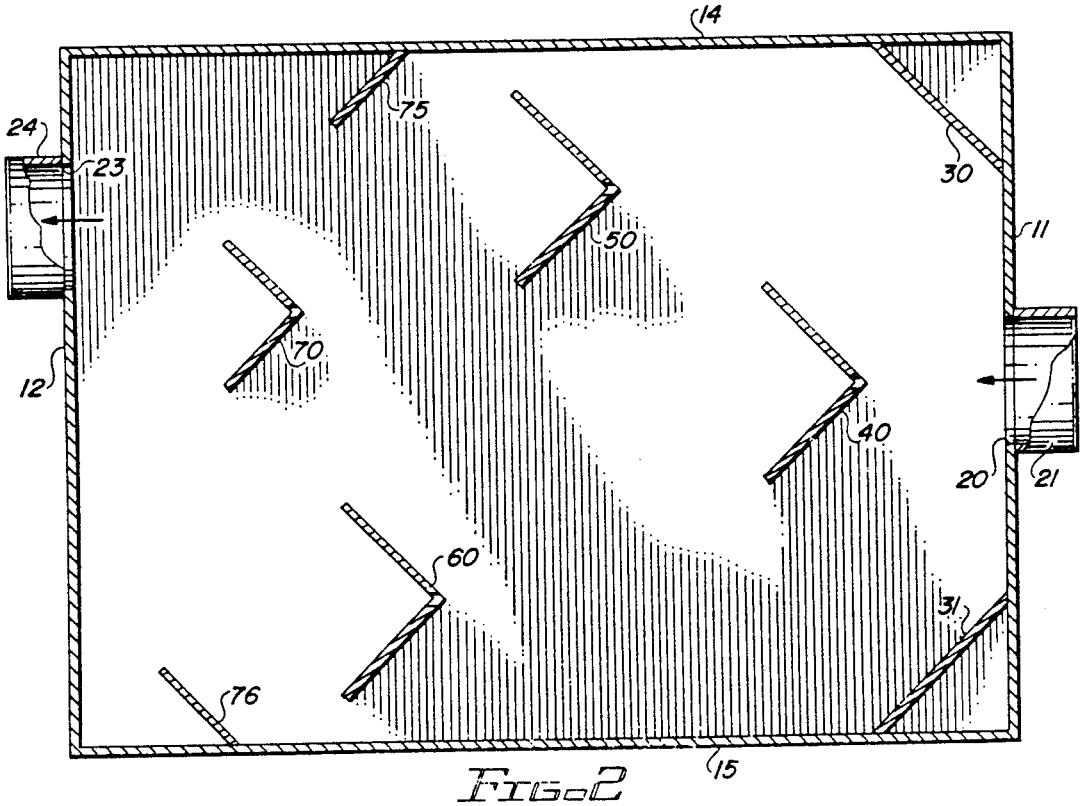
FIG. 2 is a cross-sectional top view of the embodiment shown in FIG. 1.
Figure 3:
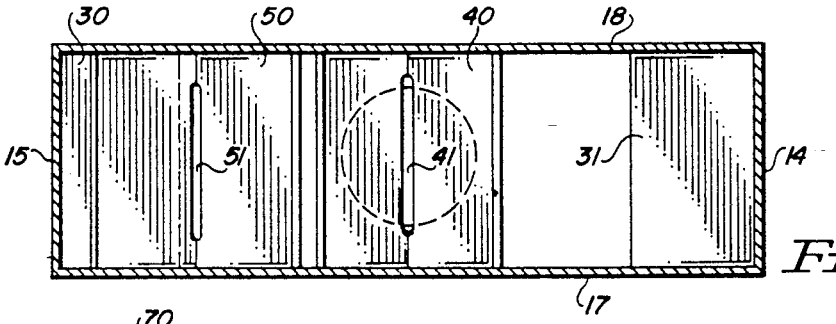
FIG. 3 is a view taken along the line 3—3 of FIG. 1.

FIG. 2 is a top view of a muffler constructed in accordance with a preferred embodiment of the invention; and FIGS. 1 and 7 are partially cut-away perspective views taken from opposite ends, respectively, of the muffler, showing the internal construction details.

The muffler 10 essentially is in the form of a closed rectangular box or casing, having in inlet end wall 11, and outlet end wall 12 interconnected by a pair of side walls 14 and 15. A bottom 17 and a top 18 complete the muffler casing enclosure. An exhaust inlet pipe 21 is connected to a circular opening 20 in the center of the end wall 11. The opposite outlet end wall 12 has a tail pipe 24 connected to a circular opening 23 formed in the wall 12. As illustrated in the embodiment of FIGS. 1, 2, and 7, the tail pipe 24 is located in an offset location, rather than in the center of the end wall 12. This primarily is a result of the vehicle configuration of the particular vehicle with which the specific muffler shown in FIGS. 1, 2, and 7 was installed. The tail pipe 24, however, may be located at any convenient point in the wall 12 for accommodating the physical requirements of the vehicle in which the muffler is installed. When a different location from the one shown, however, is used for the tail pipe 24, some rearrangement of one or more of the internal baffles, described subsequently, will be made in order to direct the exhaust gases most efficiently to the opening 23 in the wall 12.

The actual dimensions of the muffler casing 10 of an embodiment of the invention, which has been constructed, are a width of 10", a length of 13½", and a vertical height of 4". The exhaust inlet opening 20 and the outlet opening 23 are 2" in diameter, and are centered vertically in the end walls 11 and 12, respectively.

Inside the muffler, four wedge-shaped or V-shaped splitters 40, 50, 60, and 70, and four flat angular deflection plates 30, 31, 75, and 76 are located in the various positions shown in FIGS. 1, 2, and 7. These splitters and deflection plates all have a vertical height of 4" extending completely between the bottom 17 and the top 18 of the muffler casing 10, and are attached by any suitable means to the top and bottom 17 and 18, respectively, to secure them in place.

The muffler operates to split the incoming exhaust pulse entering the muffler through the exhaust pipe 21 and the aperture 20 into two equal halves, by directing the exhaust pulse to the first wedge-shaped or V-shaped pulse splitter 40 located 2" behind the aperture 30 in the wall 11, and centered in the opening. The splitter 40 includes two 2" wide deflector plates connected together at an angle of 90°, each oriented at an angle of 45° to the end wall 11. This is shown most clearly in FIG. 2. Parallel to the faces of the splitter 40 are a pair of 2½" deflector plates 30 and 31 connected across the opposite corners of the muffler casing 10 at 45° angles. These deflector plates 30 and 31 prevent any back pressure buildup from occurring as a result of reflected exhaust gases, which possibly may deflect in the direction of these corners from the front surfaces of the exhaust pulse splitter 40.

The primary function of the splitter 40 is to split the incoming exhaust pulse into two exhaust streams with one-half of the stream being diverted to the side of the casing enclosed by the side wall 14, and the other half being diverted to the side enclosed by the side wall 15 As the exhaust gas pulse stream is split into these first and second portions, the two portions essentially flow in phase with one another past the edges of the splitter 40.

An examination of FIG. 2 shows that the next pulse splitters 50 and 60 are located to intercept the two different exhaust streams, which have been split by the splitter 40. The splitters 50 and 60 are identical in dimensions to the splitter 40, and are oriented with the deflector plates connected together at an angle of 90° to one another, and oriented at an angle of 45° to the front and back walls 11 and 12 of the casing. A smaller wedge-shaped splitter 70 is located near the rear wall 12, and is positioned to intercept the exhaust streams diverted from the inside plates or legs of the splitters 50 and 60 as the exhaust streams are diverted, generally, toward the splitter 70. The structure of the muffler is completed with two additional deflector plates 75 and 76, extending at an angle of 45° outwardly from the side walls 14 and 15, respectively, and located to divert exhaust gases passing beyond the outer legs of the splitters 50 and 60 back toward the tail pipe opening 23 in the rear wall 12 of the casing 10.

In the structure which is illustrated in FIGS. 1, 2, and 7, the apices of the splitters 50 and 60 are each located 2" inwardly from the side walls 14 and 15, respectively. The apex of the splitter 50 is located 5½" from the front end wall 11, and the apex of the splitter 60 is located 8" from the end wall 11. Each of the legs of the V-shaped or wedge-shaped splitter 70 are 1½" wide, as are the deflection plates 75 and 76. The apex of the splitter 70 is located 10" from the wall 11, and 3¾" from the side wall 14. The final dimension is the location of the center of the circular tail pipe opening 23, which is 2½" from the side wall 14. All of the splitters, deflection plates, and the plates forming the casing 10 of the embodiment under description were made of 1/16" steel plate. Anti-corrosion coatings, and other materials suitable for use in mufflers, also may be used.

As is readily apparent from an examination of FIGS. 1, 2, and 7, there are four primary splitters 40, 50, 60, and 70, and four secondary deflectors 30, 31, 75, and 76. Each of the four primary splitters have vertical cut-out slots 41, 51, 61, and 71 located at the very front or apices of the respective splitters at the point of the bend to form the V-shaped splitter member. The slots are approximately 3" long, and are centered in the apex of each of the splitters. The slots 41, 51, 61, and 71 are approximately ⅛" to ¼" wide. These slots function to eliminate the reflection of exhaust gas pulses from the leading edge or leading surface of the various splitters 40, 50, 60, and 70 and, further function to prevent dead spots from occurring directly behind the splitters.

The secondary reflectors 30 and 31 function to smooth the incoming exhaust gas flow, and help to redirect the split pulses back towards the splitters 50 and 60, as described previously. Without the deflectors 30 and 31, the exhaust pulses which are split by the pulse splitter 40 could be partially reflected into the front corners of the exhaust casing 10, to build up a pressure point in the corners and finally come out in all directions, rather than allowing the exhaust stream to flow smoothly rearward toward the splitters 50 and 60.

Similarly, the deflectors 75 and 76 insure that the portions of the pulses that pass beyond the outsides of the splitters 50 and 60 are further elongated and smoothed before reaching the rear opening 23 in the rear wall 12 of the muffler.

The splitters 40, 50, 60, and 70, and the deflectors 75 and 76 perform an important additional function, beyond simply redirecting the exhaust pulses toward the opening 23 connected to the tail pipe 24 of the vehicle in which the muffler 10 is located. As the incoming exhaust pulse impacts on each of the splitters 40, 50, 60, and 70, the exhaust pulse is deformed around the plates forming the splitters. This deforming process takes a small amount of energy out of the pulse, and, more importantly, takes time to make the deformation. The most pronounced effect of this time delay occurs at the splitters 50 and 60, since the two halves of the original exhaust pulse reach the splitters 50 and 60 at different times in the rate of flow of the two streams formed by the splitter 40.

As is readily apparent, when the pulse originally is split by the splitter 40, the time delay on both sides is equal; so there is no relative phase shift in the two streams which pass on both sides of the splitter 40 down through the muffler. As these two different exhaust streams, however, move toward the splitters 50 and 60, the additional 2½" distance the apex of the splitter 60 is located from the wall 11 beyond the location of the apex of the splitter 50, causes the pulse reaching the splitter 50 to be split, delayed, and diverted inwardly on one side toward the center of the muffler prior to any similar diversion and delay of the pulse at the splitter 60.

A delay from the deformation of the pulse around the splitter 50 then is introduced into this part of the exhaust stream prior to the operation of the splitter 60 on the other half of the original pulse split by the splitter 40. Consequently, the pulse streams now are out of phase with one another, and recombine to move toward the splitter 70 in an integrated fashion. Additional out-of-phase time delays are introduced by the deflector plates 75 and 76, because of their different distance locations from the front wall 11 of the casing (8½" for the plate 75 versus 11" for the plate 76).

The result of this operation is an intermodulation of all of the fractional parts of the original exhaust pulse entering the muffler through the inlet opening 20. A generally continuous (that is, non-pulsating) flow of exhaust gas is directed toward the outlet opening 23 as a result of the different time delays introduced by the locations of the splitters 50, 60, and deflectors 75 and 76. The highest frequency components are significantly attenuated, as well as low frequency components. The incoming pulse resembles an impulse with odd frequency harmonics far above the primary frequency.

The relative closeness of the splitters 50 and 60 to the outer walls 14 and 15, respectively, adds another dimension to the elongation of the pulses in the two streams passing to the outside of the splitters. This causes additional relative phase shifts in this portion of the split streams. In the device constructed in accordance with the dimensions given above, the splitters 50 and 60 create a ⅝" space between the outer edges of the splitter faces and the walls 14 and 15, respectively. This distance causes a slight fluid flow crowding region. The portions of the exhaust gas stream going to the outsides of the splitters 50 and 60 encounter a slight trap between the splitters and the walls 14 and 15. This develops capacitances for the gases, which become slightly pressurized at this point. The calibrated distance between the edges of the splitters 50 and 60 and the walls 14 and 15 creates a resistance to air current flow. Thus, there is a capacitance drained through a resistance, which promotes pulse elongation and phase shift in the exhaust gas streams flowing through this portion of the muffler.

The exhaust gas streams passing through these capacitance/resistance regions still have high energy components in them; so that the deflection plates 75 and 76 deflect this energy back into the modulation area around the splitter 70 for further sound attenuation or quieting. This further quieting takes place in a reintegration of all of the exhaust pulse streams striking the splitter 70 and the deflection plates 75 and 76. The splitter 70 introduces final time delaying aspects to the fractions of the exhaust gas streams striking it to produce a final reintegration of all of the fractional pulses throughout the muffler, and to insure that no portion of the exhaust gas stream is permitted to pass straight through the muffler from the inlet opening 20 to the outlet opening 23.

An important design concept in the muffler 10 is the angles of orientation of the splitters 40, 50, 60, 70, and the deflector plates 30, 31, 75, and 76. As is apparent from the foregoing description, the primary task of the splitter 40 is to divide the incoming pulse into two equal exhaust gas streams. It is equally important, however, that no reflection of any portion of the incoming exhaust gas pulses are made back to the engine. As explained previously, the slot 41 in the splitter 40 prevents any portion of the center of the exhaust pulse from being reflected directly back toward the engine.

Additionally, it is apparent that there are relatively large open areas between the different splitters 40, 50, 60, and 70. It is important to allow this room or space so that the exhaust gas pulses have room to expand and to be deformed around the various splitters without building pressure heads, which would possibly result in back pressure toward the engine.

As mentioned previously, the capacitance effect, which is produced by the outside plates of the splitters 50 and 60, and the corresponding walls 14 and 15, possibly could result in potential reflection from these points. This is negated, however, by the strong fluid flow of exhaust directed toward the center of the muffler by the internal plates of the splitters 50 and 60. This fluid flow pulls toward the inside, and taps off any portions of pulses from the outsides of the splitters 50 and 60, which otherwise might tend to reflect back toward the inlet opening 20.

It also is obvious from an examination, particularly of FIG. 2, that the angles of the deflectors 75 and 76, and of the splitters 40, 50, 60, and 70, function to create a type of "one-way" valve concept to block any reverse fluid flow or back pressure toward the inlet opening 20 in the wall 11. The angles of these elements all tend to trap or stop any possible tendency for a reverse fluid flow from the opening 23 to the opening 20 of the muffler. Consequently, if reversion through the muffler were somehow attempted, for example, due to a burned exhaust valve in the engine, the reverse flow would encounter pressure heads at all of the splitters 40, 50, 60, and 70,. as well as the deflector plates 75 and 76. Each of these points would cause pressure heads to build, and due to the associated angles, each of them would reflect back toward the tail pipe opening 23 to block any tendency for any reversionary inrush pulse from being sustained through the muffler, or in the reverse direction through the opening 20 to the exhaust pipe 21. This is clearly shown in FIG. 3.

Figure 4:
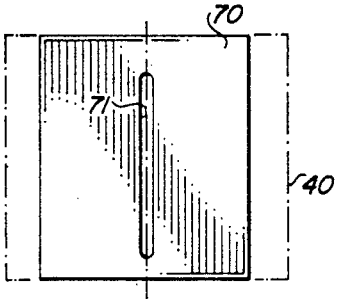
FIGS. 4, 5, and 6 illustrate details of the construction of parts used in the embodiment of FIGS. 1, 2, and 3.
Figure 6:
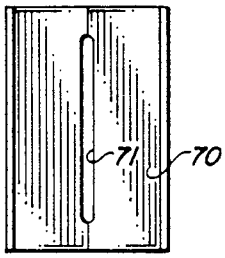
Figure 5:
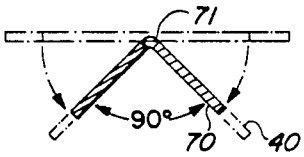

FIGS. 4, 5, and 6 illustrate the manner in which the splitter 70 (shown in solid lines), and the splitter 40 (shown in dotted lines) are formed. As illustrated in FIG. 4, the splitter is made of a rectangular sheet of metal with a slot 71 cut in its center. It then is bent 90° about this center line, as shown in FIG. 5, to assume the end-on configuration shown in FIG. 6. The solid line representation for the splitter 70, which is superimposed over the dotted line representation for the splitter 40, provides an indication of the different relative dimensions of the small splitter 70 and the larger splitters, such as 40, which are used in the system.

The foregoing description of the preferred embodiment of the invention is to be considered as illustrative of the invention, and not as limiting. The various sizes and distances of the design are flexible, and may be modified to optimize the design to match different engines, and also modified, depending upon whether or not the engine with which the muffler is used has a turbo charger. Variations of a few degrees can be employed in the angles of the various splitters and deflectors without substantially changing the operating characteristics. In addition, the sizes of the splitters can be varied somewhat; and variations in the distances described can be effected by those skilled in the art without departing from the true scope of the invention as defined in the appended claims.

I claim:

1. An improvement in a muffler for an internal combustion engine, where the muffler has a casing with a pair of end walls interconnected with first and second sides and with an inlet opening on one end wall and an outlet opening on the opposite end wall, said improvement including in combination:

a first exhaust pulse splitting means located in said casing near said inlet opening a first predetermined distance from said one end wall for splitting exhaust flowing into said casing from said inlet opening into separate first and second parallel flowing exhaust streams directed toward said first and second sides, respectively;

a second exhaust pulse splitting means in said casing in the path of said first parallel exhaust stream a second predetermined distance from said one end wall and located nearer said first side than said second side for further splitting said first exhaust stream into third and fourth parallel flowing exhaust streams;

a third exhaust splitting means in said casing in the path of said second parallel exhaust stream a third predetermined distance from said one end wall and located nearer said second side than said first side for further splitting said second exhaust stream into fifth and sixth parallel flowing exhaust streams, said third predetermined distance being greater than said second predetermined distance, so that said second exhaust pulse splitting means is located nearer to said first exhaust pulse splitting means than said third exhaust pulse splitting means is located to cause said exhaust streams from said second and third exhaust pulse splitting means to be out of phase with one another; and combining means for mixing together said third, fourth, fifth and sixth exhaust streams from said second and third exhaust pulse splitting means for supplying exhaust to said outlet opening.

2. The combination according to claim 1 wherein said casing is a rectangular casing having a top and bottom, inlet and outlet ends, and first and second sides, with said first, second and third splitting means extending fully between said top and bottom thereof.

3. The combination according to claim 2 wherein said first, second, and third exhaust pulse splitting means each comprise flat rectangular plates.

4. The combination according to claim 3 wherein said first exhaust pulse splitting means splits exhaust flowing into said casing from said inlet opening into two substantially equal fist and second parallel flowing exhaust streams.

5. The combination according to claim 4 wherein said first exhaust pulse splitting means is a generally wedge-shaped deflector member having an apex directed toward said inlet opening.

6. The combination according to claim 5 wherein said second and third exhaust pulse splitting means each comprise wedge-shaped deflector members having an apex directed toward said inlet opening to receive said respective first and second flowing exhaust streams.

7. The combination according to claim 6 wherein said combining means includes deflection panel means located within said casing to complement the operation of said first and additional exhaust pulse splitting means.

8. The combination according to claim 1 wherein said casing has a top and bottom and said first, second and third exhaust pulse splitting means comprise generally V-shaped wedges extending from top to bottom inside said casing.

9. The combination according to claim 8 wherein each of said first, second and third exhaust pulse splitting means comprises a V-shaped wedge having an apex with an aperture therethrough to permit exhaust gases striking said apex thereof to pass therethrough.

10. The combination according to claim 9 wherein each of said V-shaped wedges comprise flat side plates interconnected together to form an apex at an angle of substantially 90°, and oriented at an angle of 45° to said end walls of said casing.

11. The combination according to claim 1 wherein said first exhaust pulse splitting means splits exhaust flowing into said casing from said inlet opening into two substantially equal first and second parallel flowing exhaust streams.

12. The combination according to claim 1 wherein said first exhaust pulse splitting means is a generally wedge-shaped deflector member having an apex directed toward said inlet opening.

13. The combination according to claim 12 wherein said second and third exhaust pulse splitting means comprise wedge-shaped deflector members each having an apex, with the apices thereof directed toward the direction of flow of said respective first and second exhaust streams.

14. The combination according to claim 1 wherein said first, second and third exhaust pulse splitting means each comprise flat rectangular plates.

15. The combination according to claim 1 wherein each of said first, second and third exhaust pulse splitting means comprises a generally V-shaped wedge with flat side plates interconnected together at an apex at an angle of substantially 90°, and oriented at an angle of 45° to said end walls of said casing.

16. The combination according to claim 15 wherein said casing is a rectangular casing having a top and bottom, inlet and outlet ends, and first and second sides, with said first and additional splitting means extending fully between said top and bottom thereof.

17. The combination according to claim 1 wherein said combining means includes deflection panel means located within said casing to complement the operation of said first, second and third exhaust pulse splitting means.

* * * * *